United States Patent [19]

Forster

[11] 4,125,058

[45] Nov. 14, 1978

[54] AXIAL PISTON MACHINE FOR ADJUSTABLE STROKE

[75] Inventor: Franz Forster, Mühlbach, Fed. Rep. of Germany

[73] Assignee: Linde Aktiengesellschaft, Höllriegelskreuth, Fed. Rep. of Germany

[21] Appl. No.: 766,150

[22] Filed: Feb. 7, 1977

Related U.S. Application Data

[63] Continuation of Ser. No. 625,096, Oct. 23, 1975, Pat. No. 4,026,195.

[30] Foreign Application Priority Data

Oct. 29, 1974 [DE] Fed. Rep. of Germany ..... 2451380

[51] Int. Cl.[2] ..... F01B 13/04

[52] U.S. Cl. ..... 91/506; 417/222

[58] Field of Search ..... 417/222, 270; 91/504–507

[56] References Cited

U.S. PATENT DOCUMENTS

| | | | |
|---|---|---|---|
| 2,389,232 | 11/1945 | Conlon | 91/339 |
| 3,332,323 | 7/1967 | Roeske | 92/12.2 |
| 3,937,130 | 2/1976 | Adams et al. | 91/339 |
| 3,967,541 | 7/1976 | Born et al. | 91/506 |

*Primary Examiner*—William L. Freeh
*Attorney, Agent, or Firm*—Karl F. Ross

[57] ABSTRACT

An axial piston machine with a variable or adjustable stroke comprises a rotatable cylinder drum provided with annularly spaced cylinder bores each of which receives a piston reciprocal in its bore parallel to the axis of rotation of the drum and with a stroke determined by the extent of tilt of a guide surface about an axis perpendicular to the axis of rotation of the drum. The piston stroke is controlled by a rocker carrying the control surface and hydraulically displaceable in the machine housing by application of hydraulic fluid pressure directly to the rocker.

5 Claims, 3 Drawing Figures

AXIAL PISTON MACHINE FOR ADJUSTABLE STROKE

This is a continuation of application Ser. No. 625,096 filed Oct. 23, 1975, now U.S. Pat. No. 4,026,195.

FIELD OF THE INVENTION

The present invention relates to axial-piston machines which are capable of operating as hydraulic pumps or motors (preferably hydraulic axial piston pumps) of the inclinable control-surface type. More particularly, the invention relates to improvements in controlling the stroke of such machines.

BACKGROUND OF THE INVENTION

Axial piston machines are known in a wide variety of configurations for use as motors and pumps and have been described generally in my application Ser. No. 558,273 filed Mar. 14, 1975 and earlier patents issued to me alone and jointly with others. Such machines have the advantage that, generally speaking, the stroke and operating capacity can be varied by the displacement of a control element.

A typical axial piston machine (pump or motor) which may be used in a variable speed hydrostatic transmission or in any other hydraulic force transmission system, comprises a housing formed with a valve plate or other surface having a pair of kidney-shaped apertures connected respectively to an inlet and an outlet for the hydraulic fluid media. A cylinder drum is rotatable against the valve plate or surface and is formed with a plurality of angularly spaced cylinder bores which surround the rotation axis of the drum and are generally parallel thereto, receiving respective pistons. The pistons project from the cylinder drum and, at their exposed extremities act against a control surface which may be tilted about an axis perpendicular to the axis of the drum. In a tilted position of this control surface (e.g. a control plate also known as a swash plate) certain pistons tend to extend out of the cylinder drum while other pistons tend to recede into the latter as the drum is rotated so that the stroke of each piston represents the excursion between its innermost and outermost positions. When the drum is driven by a shaft journaled in the housing, the pistons are alternately forced into and out of their respective bores to expel fluid through a discharge port and induce fluid through the oppositely functioning or inlet port so that the machine operates as a pump. When, however, fluid is forced into an inlet port and urges pistons outwardly from retracted positions, a shaft connected to the drum directly or indirectly is compelled to rotate and the machine operates as an axial-piston motor.

When the control surface lies in a plane perpendicular to the axis of rotation of the drum, the pistons undergo no excursion with drum rotation and the machine is said to be operated in a neutral mode. In this mode, when the machine is a pump, there is effectively no displacement and, when the machine is a motor, the output shaft is at standstill.

In general, the displacement of the control surface, i.e. a control plate or swash plate, is effected by a hydraulic servomechanism having a cylinder for a piston linearly shiftable in the cylinder and coupled to the pivotal plate by a complex linkage designed to convert the linear movement of the actuating piston to a tilting movement of the control plate. Generally this linkage consists of a plurality of elements or bodies, i.g. links or levers, of relatively high cost. Furthermore, such multi-element linkages are not able to provide a play-free positioning of the control surface without mechanically stressing the elements to an undesirable extent and producing a binding or the like. For the most part, such systems are prone to wear, require relatively large stroke for the servopistons and therefore a large length with numerous difficulties with respect to constructing the servomechanism in the housing for the axial piston machines. Manufacturing costs are high, the weight of the unit is increased and the capacity per unit size is reduced by the need for a complex large-stroke servomechanism.

OBJECTS OF THE INVENTION

It is the principal object of the present invention to provide an improved axial piston machine having a control-surface positioning means or mechanism whereby the above mentioned disadvantages are avoided and which is of low manufacturing cost and wherein the positioning device for the control surface occupies a minimum of space.

SUMMARY OF THE INVENTION

This object is attained, in accordance with the present invention by providing, directly in the housing of the axial piston machine a pivotal-swing, pivotal-lobe or swingable-flap drive with an angularly displaceable piston which is mechanically provided directly with the control surface of the machine. The rotatable piston, which is swingable back and forth about the pivot axis of the control surface perpendicular to the axis of rotation of the cylinder drum defines, within the machine housing, one or more working compartments which are directly chargeable with fluid to obtain the angle deflection of this member, hereinafter referred to as a rocker. While rockers are known to carry the control surface, it is important for the purposes of the present invention to appreciate that the rocker itself constitutes one or more lobes of an angularly displaceable piston and may be a tiltable vane, wing or flap one side of which receives pressure from a medium charged into a working compartment.

Consequently, the conventional linearly shiftable servopiston, with the force transmitting elements necessary to convert linear motion to an angular motion of the control surface, is no longer required since the positioning movement is initially an angular displacement.

Preferably the rotating-piston drive has its tilting vanes coaxial with the pivotal axis of the rocker carrying the control surface and is connected therewith, e.g. by being integral with the rocker. However, the tiltable vane drive can be disposed adjacent the rocker in the direction of the tilting axis although this construction has the disadvantage that it requires additional room.

It has been found most advantageous to provide the working compartment of the hydraulic servomechanism or positioning device so that it is at least in part bounded by the rocker. The working compartment can be located within the rocker or disposed along the periphery of the latter.

Such a structure should be distinguished from that described in German Offenlegungsschrift No. 1,528,527 in which a rotary-vane drive is provided for a tilting member of a hydraulic machine as an independent unit which is located adjacent or auxiliary to the machine. In the present case, the rocker itself constitutes the servo-piston of the control arrangement.

Since the rocker is the control piston of the servo-mechanism, separate elements connected thereto for displacing the rocker can be eliminated, the rocker-occupied space can form the servochambers, and overloading or stress of a force transmission system does not occur.

For a rotary drive, according to the invention, it is necessary to have the coaxial cylindrical boundary surfaces which together define the working chamber. The outer of these boundary surfaces is, according to the invention, always fixed to the housing. While the inner boundary surface can be part of the rocker or another element which can be fixed to the housing or which independently surrounds the shaft of the machine. This has been found to be particularly advantageous when the working chamber is provided along an outer portion of the rocker or in the housing.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
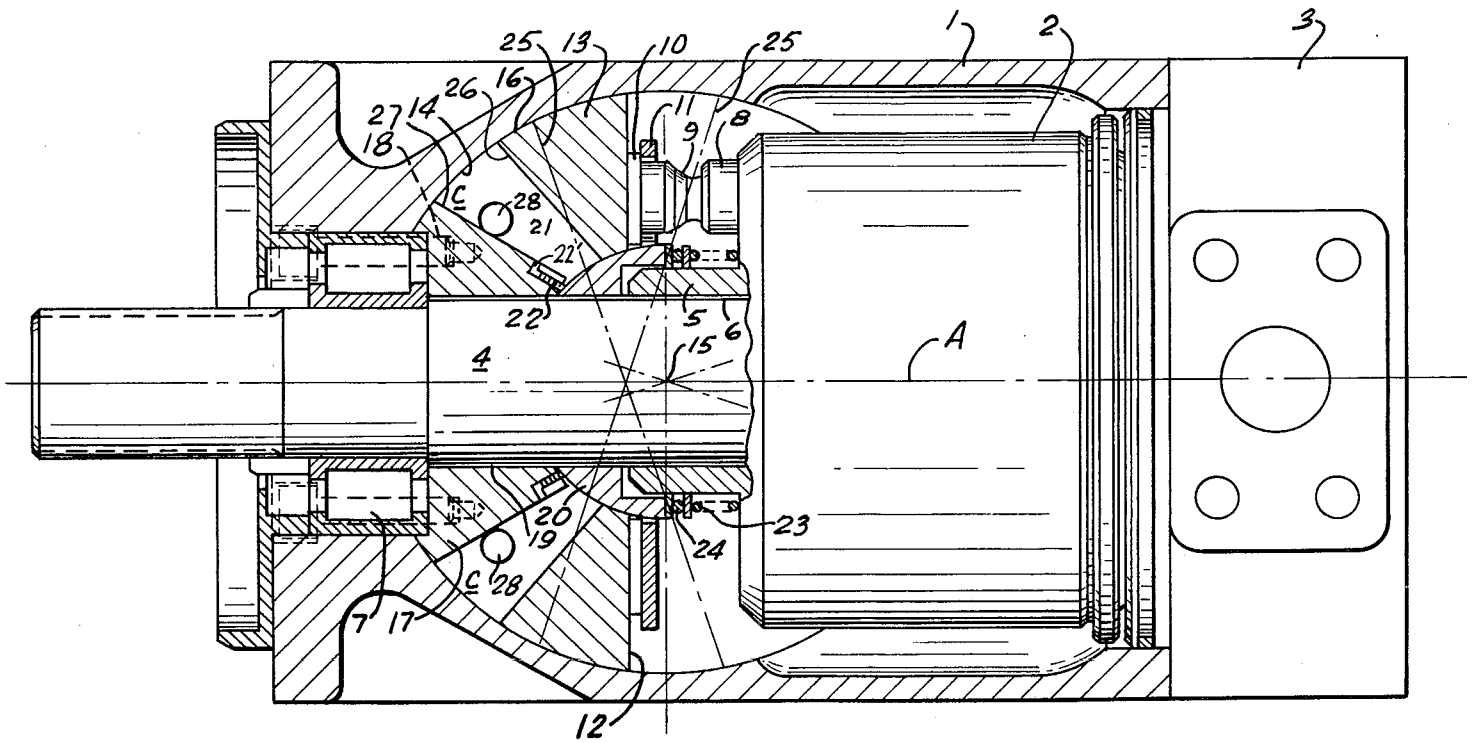
FIG. 1 is an axial section through an axial-piston machine according to this invention.

As shown in FIG. 1 a housing 1 centered on a main axis A is provided with a rotor 2 itself resting against a base valve plate 3 as described in my above-cited patent application. The rotor 2 has a neck 5 connected by splines 6 to a shaft 4 extending out of the housing and centered on the axis A. A bearing 7 rotatably supports the shaft 4.

Pistons 8 angularly equispaced about the rotor 2 have ball heads 9 extending therefrom and resting against a slide plate 10 whose edge is protected by a pressing plate 11 as is known in the art. The plate 10 slides on the front face 12 of a rocker 13 tippable about an axis 15 perpendicular to and intersecting the axis A. This rocker 13 has an outer surface 16 that rides on a cylindrical surface 15 forming a seat inside the housing 1.

A separating body 17 secured rigidly in the housing via screws 18 has a throughgoing hole 19 closely surrounding the shaft 4. A sealing body 20 has a cylindrical outer surface 21 that sealingly engages against a corresponding radially inner surface of the rocker 13. Seals 22 are provided between the separating body 17 and the body 20, with small passages 22 provided so that fluid pressure may force these seals 22 into contact with the surface 21. The body 20 itself is pressed by means of springs 23 and a roller bearing 24 against the rocker 13. Thus the side of the body 20 turned toward the rotor 2 is shaped as a body of revolution about the axis A so that the sliding plate 10 and the pressure plate 11 can rotate about this part 20, with the surfaces 21 being either spherical or cylindrical about the axis 15. The two dot-dash lines 25 show the stream end positions into which the front face 12 of the rocker can be pivoted.

The back faces 26 of the rocker 13 define with the front faces 27 of the dividing body 17 and with the inner surface 14 of the seat and the outer surface 21 of the body 20 a pair of pressurizable compartments C each having a respective filling hole 28 adjacent the surface 27.

Forcing fluid into one of the compartments C and drawing fluid from the other compartment C will therefore tilt the rocker 13. The extent of tilt from a position with the planar surface 12 normal to the axis A determines the stroke of the pistons 8 and, therefore, the amount of pumping effected by these pistons whether they are acting as a motor or a pump.

Figure 2:
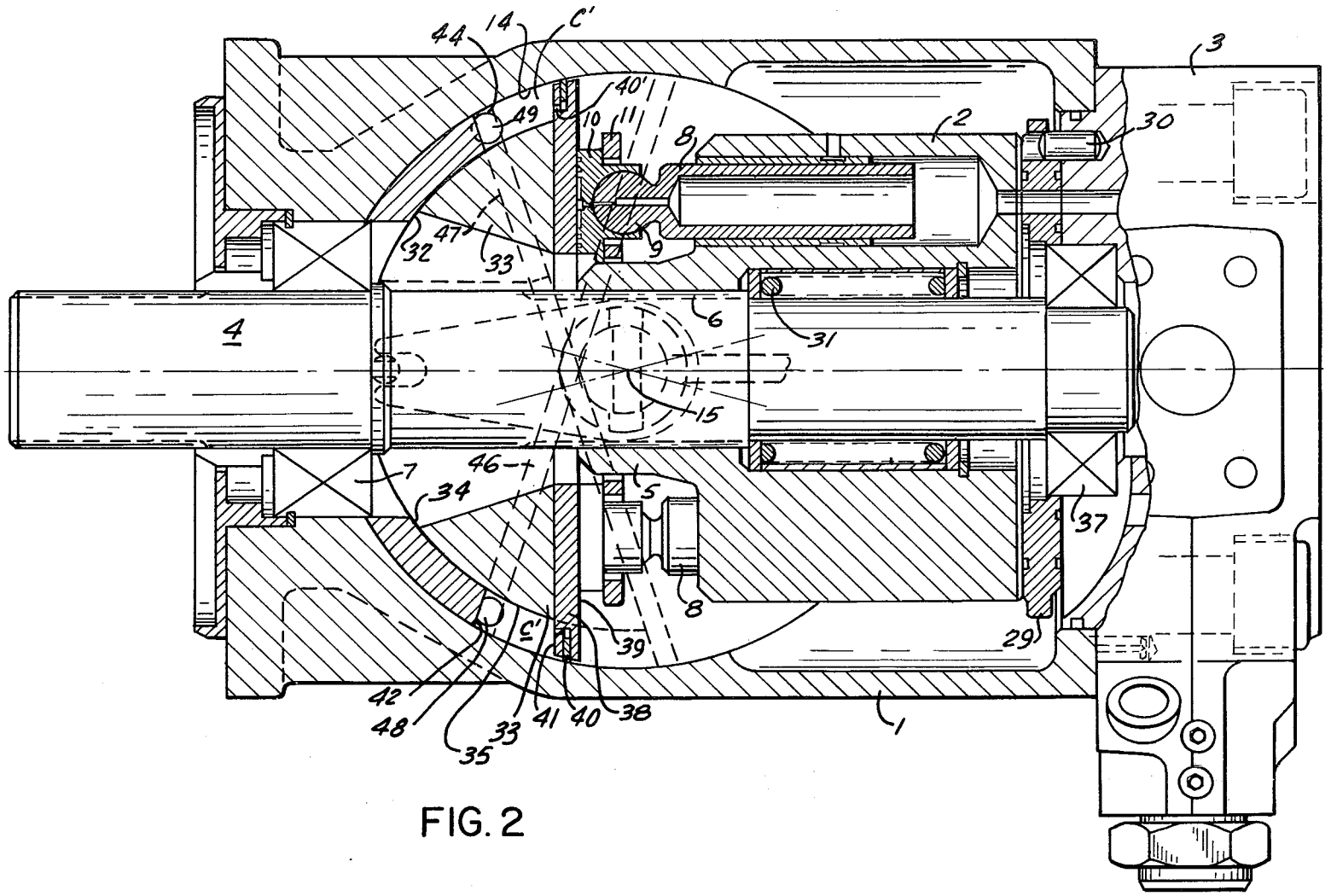
FIG. 2 is a similar section through another machine in accordance with this invention.
Figure 3:
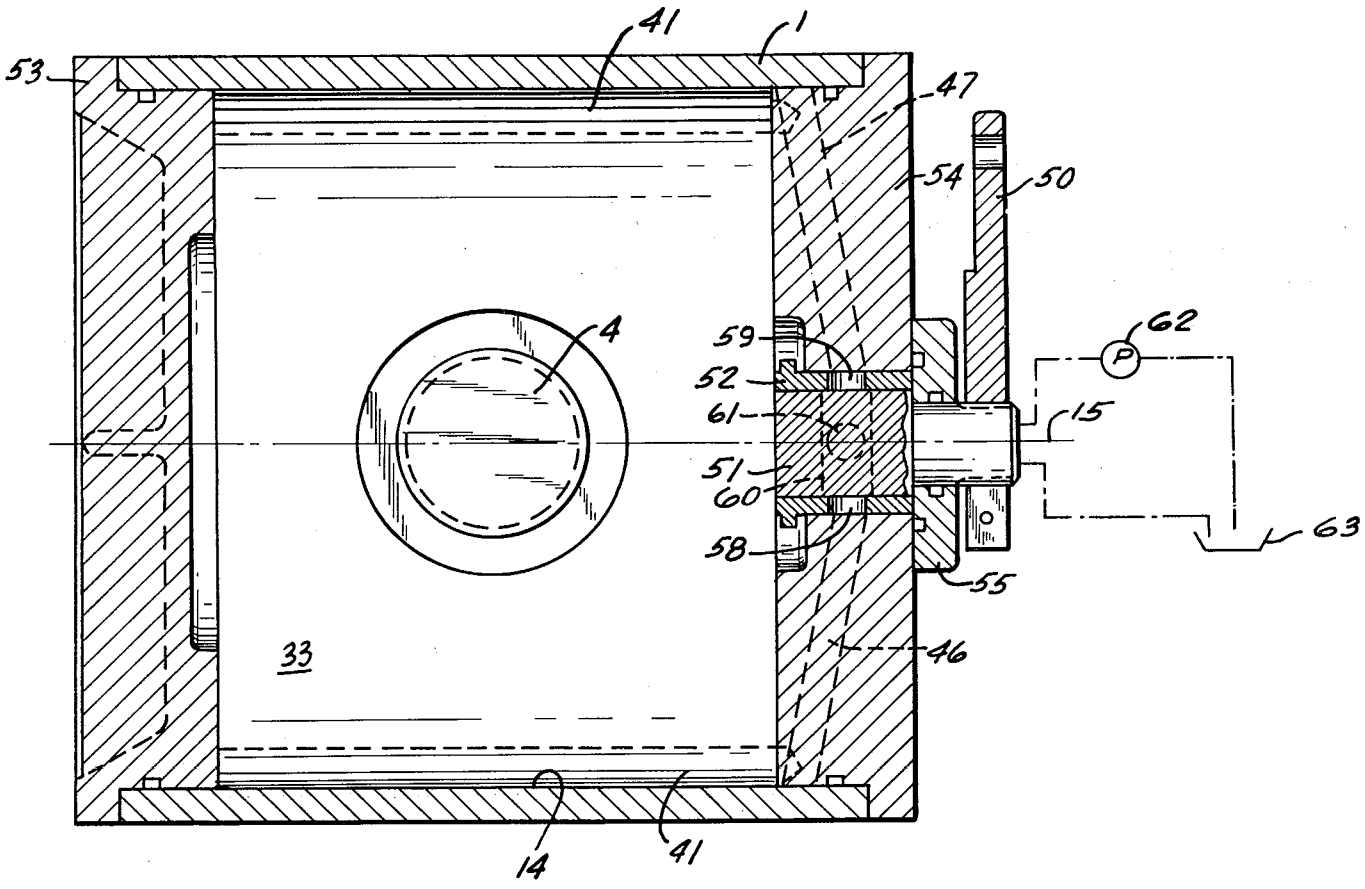
FIG. 3 is a cross section through the machine of FIG. 2.

The arrangements shown in FIGS. 2 and 3 use the same reference numerals used in FIG. 1 where the structure is identical. Here the cylinder drum or rotor 2 bears against the valve plate 3 via an intermediate plate 29 prevented from rotating by pins 30. A spring 31 urges the rotor 2 against the plate 29. In addition a bearing 37 is provided at the far end of the shaft 4 to support it in the housing 1.

The housing 1 here includes a shell-like liner 32 fitted between a rocker core 33 and the seat 15 and braced against the bearing 7 so as to be nonmovable within the housing 1. The inner surface 34 of the liner 32 lies on an imaginary cylinder centered on the axis 15, and the outer cylindrical surface 35 of the core 33 slides on this surface 34.

The rocker comprises in addition to the core 33 a flat plate 38 having a front face 39 on which ride the plates 10 and 11 for the pistons 8 and a back face exposed at 41 around the edges of the core 33. Seals 40 are urged by pressure through passages 40' against the seat 14. Thus a pair of chambers C' are defined between the surface 41 of the plate 38, the outer surface 35 of the core 33, the front face 42 of the liner 32, and the seat 14. Introduction of fluid into the lower compartment C' and simultaneous withdrawal of fluid from the upper compartment displaces the rocker 33, 38 into the position indicated at 44 in dot-dash lines. Opposite pressurization and depressurization of these chambers will tilt it into the position indiccated at 45 in dot-dash lines. This pressurization is effected by means of fluid passages 46 and 47 respectively opening at the holes 48 and 49 into the chambers C'.

FIG. 3 illustrates how these chambers 46 and 47 are formed in one planar side wall 54 of the housing 1, having an opposite and correspondingly flat side wall 53. The passages 46 and 47 are alignable with throughgoing holes or orifices 58 and 59 formed in a tubular element 52 centered on the axis 15 and rotationally linked to the core 53. In addition within this tube 52 there is journaled a valve rod 51 formed with passages 60 and 61 alignable with the orifices 58 and 59 and therethrough with passages 46 and 47. A plate holds these two elements 51 and 52 in place and an adjustment lever 50 is provided for establishing the angular position of the rotatable central element 51. A pump 62 and reservoir 63 are connected with the passages 60 and 61, respectively, so as to allow pressurization of one of the chambers C' and depressurization of the other depending on the position of the lever 50.

When the lever 50 is moved angularly from one to another position fluid will be able to flow through the holes 58 and 59 so as to pressurize one of the chambers C' and depressurize the other until the rocker 33, 38 tips sufficiently to pull the orifices 58 and 59 out from between the passages 36, 47, 60 and 61 and thereby disrupt the fluid flow between them. Thus the element 51 merely serves as a valve, and itself exerts no force on the rocker, which automaticaly assumes the desired position and, in case of leakage, automatically returns to this position.

I claim

1. In an axial piston machine having a hydraulic control means for setting the stroke of the pistons of a cylinder drum rotatable about a first axis, the pistons bearing against a piston-running surface inclined to said first axis, said piston-running surface being formed on a rocker having a cylindrical surface rotatable against a cylindrical countersurface of a machine housing and centered upon a second axis perpendicular to said first axis, the inclination of said piston-running surface to said first axis being adjustable by said hydraulic means by rotation of said rocker about said second axis, the improvement wherein said hydraulic control means includes a hydraulically displaceable swinging-vane drive coaxial with said second axis and acting upon said rocker, said swinging-vane drive having a hydraulically pressurizable compartment, said rocker defining a wall of said compartment, said cylindrical countersurface of said housing being stepped and comprising a first surface portion of relatively small radius of curvature proximal to said first axis and a second surface portion coaxial with said first portion and lying outwardly thereof with respect to said first axis, said wall lying between said cylindrical surface of said rocker and said second surface portion.

2. The improvement defined in claim 1 wherein said first surface portion is formed by a shell received in said housing and coaxial with said second surface portion along said first axis.

3. The improvement defined in claim 1 wherein said wall is formed as a disk sealingly engaging said second surface portion.

4. In an axial piston machine having a hydraulic control means for setting the stroke of the pistons of a cylinder drum rotatable about a first axis, the pistons bearing against a piston-running surface inclined to said first axis, said piston-running surface being formed on a rocker having a cylindrical surface rotatable against a cylindrical countersurface of a machine housing and centered upon a second axis perpendicular to said first axis, the inclination of said piston-running surface to said first axis being adjustable by said hydraulic means by rotation of said rocker about said second axis, the improvement wherein said hydraulic control means includes a hydraulically displaceable swinging-vane drive coaxial with said second axis and acting upon said rocker, said swinging-vane drive having a hydraulically pressurizable compartment, said rocker having a cylindrical wall defining a wall of said compartment.

5. In an axial piston machine having a hydraulic control means for setting the stroke of the pistons of a cylinder drum rotatable about a first axis, the pistons bearing against a piston-running surface inclined to said first axis, said piston-running surface being formed on a rocker having a cylindrical surface rotatable against a cylindrical countersurface of a machine housing and centered upon a second axis perpendicular to said first axis, the inclination of said piston-running surface to said first axis being adjustable by said hydraulic means by rotation of said rocker about said second axis, the improvement wherein said hydraulic control means includes a hydraulically displaceable swinging-vane drive coaxial with said second axis and acting upon said rocker, said swinging-vane drive having a hydraulically pressurizable compartment, the cylindrical surface and a radial wall of said rocker each defining a wall of said compartment.

* * * * *